US012104587B2

(12) United States Patent
Publes et al.

(10) Patent No.: US 12,104,587 B2
(45) Date of Patent: Oct. 1, 2024

(54) CONTROLLING A DISCHARGE PRESSURE FROM A PUMP FOR PRESSURE TESTING A FLUID SYSTEM

(71) Applicant: Caterpillar Inc., Peoria, IL (US)

(72) Inventors: Andy Publes, Katy, TX (US); Mark C. Paul, Carmel, IN (US); Mark Francis Grimes, Cypress, TX (US); Todd Ryan Kabrich, Tomball, TX (US); Riadh Benguedda, Cypress, TX (US)

(73) Assignee: Caterpillar Inc., Peoria, IL (US)

( * ) Notice: Subject to any disclaimer, the term of this patent is extended or adjusted under 35 U.S.C. 154(b) by 285 days.

(21) Appl. No.: 17/649,531

(22) Filed: Jan. 31, 2022

(65) Prior Publication Data

US 2023/0243348 A1 Aug. 3, 2023

(51) Int. Cl.
*F04B 49/06* (2006.01)
*E21B 43/26* (2006.01)
*F04B 51/00* (2006.01)

(52) U.S. Cl.
CPC ..... *F04B 49/06* (2013.01); *E21B 43/2607* (2020.05); *F04B 51/00* (2013.01)

(58) Field of Classification Search
CPC ..... F04B 49/06; F04B 51/00; E21B 43/2607
See application file for complete search history.

(56) References Cited

U.S. PATENT DOCUMENTS

| | | | | |
|---|---|---|---|---|
| 10,378,335 | B2 | 8/2019 | Chong | |
| 10,745,993 | B2 | 8/2020 | Urdaneta | |
| 11,035,213 | B2 | 6/2021 | Dusterhoft et al. | |
| 11,091,992 | B2 | 8/2021 | Broussard et al. | |
| 2016/0258267 | A1* | 9/2016 | Payne | E21B 21/062 |
| 2017/0002805 | A1* | 1/2017 | Williams | F04B 17/03 |
| 2017/0212535 | A1 | 7/2017 | Shelman et al. | |
| 2018/0073346 | A1* | 3/2018 | Urdaneta | G05B 19/02 |
| 2020/0232454 | A1 | 7/2020 | Chretien et al. | |
| 2021/0063271 | A1* | 3/2021 | Mazrooee | E21B 43/26 |
| 2021/0131410 | A1 | 5/2021 | Curry et al. | |
| 2021/0396123 | A1* | 12/2021 | Yeung | F04B 49/08 |
| 2022/0213781 | A1* | 7/2022 | Parthasarathy | F04D 15/0088 |

* cited by examiner

*Primary Examiner* — Connor J Tremarche
(74) *Attorney, Agent, or Firm* — Harrity & Harrity, LLP

(57) ABSTRACT

In some implementations, a controller may obtain a setting for a target discharge pressure associated with a fluid pump driven by a motor that is controlled by a variable frequency drive (VFD). The target discharge pressure may be for use in a pressure test of a system that includes the fluid pump. The controller may determine a target torque for the motor that achieves the target discharge pressure. The controller may cause, via the VFD and in connection with the pressure test, adjustment to a speed of the motor to achieve the target torque for the motor.

20 Claims, 3 Drawing Sheets

CONTROLLING A DISCHARGE PRESSURE FROM A PUMP FOR PRESSURE TESTING A FLUID SYSTEM

TECHNICAL FIELD

The present disclosure relates generally to hydraulic fracturing systems and, for example, to controlling a discharge pressure from a pump for pressure testing a fluid system.

BACKGROUND

Hydraulic fracturing is a well stimulation technique that typically involves pumping hydraulic fracturing fluid into a wellbore (e.g., using one or more well stimulation pumps) at a rate and a pressure (e.g., up to 15,000 pounds per square inch) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

Prior to operation of a hydraulic fracturing system, a pressure test may be performed to verify the integrity of the system (e.g., the integrity of the plumbing of flow lines to a well head). To perform the pressure test, an operator may manually increase the speed of one or more pumps of the hydraulic fracturing system until a target discharge pressure for the pressure test is achieved. Thus, a success of the pressure test may be dependent upon the particular experience of the operator and the operator's ability to achieve the target discharge pressure without exceeding system safety parameters (e.g., system overpressure settings). In the event of an unsuccessful pressure test, the operator may repeat the process until the target discharge pressure is achieved and the pressure test is successful. Variabilities of the hydraulic fracturing system may cause the discharge pressure to oscillate even after the target discharge pressure is achieved, thereby affecting the results of the pressure test.

The control system of the present disclosure solves one or more of the problems set forth above and/or other problems in the art.

SUMMARY

In some implementations, a system for hydraulic fracturing includes at least one fluid conduit, a fluid pump in fluid communication with the at least one fluid conduit, a motor configured to drive the fluid pump, a variable frequency drive (VFD) configured to control the motor, and a controller configured to: receive an input that indicates a setting for a target discharge pressure associated with the fluid pump that is to be used for a pressure test of the system; determine a target torque for the motor, that achieves the target discharge pressure, based on a configuration of the fluid pump; and cause, via the VFD and in connection with the pressure test, adjustment to a speed of the motor to achieve the target torque for the motor.

In some implementations, a method includes obtaining, by a controller, a setting for a target discharge pressure associated with a fluid pump driven by a motor that is controlled by a VFD, the target discharge pressure for use in a pressure test of a system that includes the fluid pump; determining, by the controller, a target torque for the motor that achieves the target discharge pressure; and causing, by the controller via the VFD and in connection with the pressure test, adjustment to a speed of the motor to achieve the target torque for the motor.

In some implementations, a controller includes one or more memories, and one or more processors configured to: obtain a setting for a target discharge pressure associated with a fluid pump driven by a motor that is controlled by a VFD, the target discharge pressure for use in a pressure test of a system that includes the fluid pump; determine a target torque for the motor that achieves the target discharge pressure; and adjust, using the VFD, a speed of the motor to achieve the target torque for the motor.

DETAILED DESCRIPTION

Figure 1:
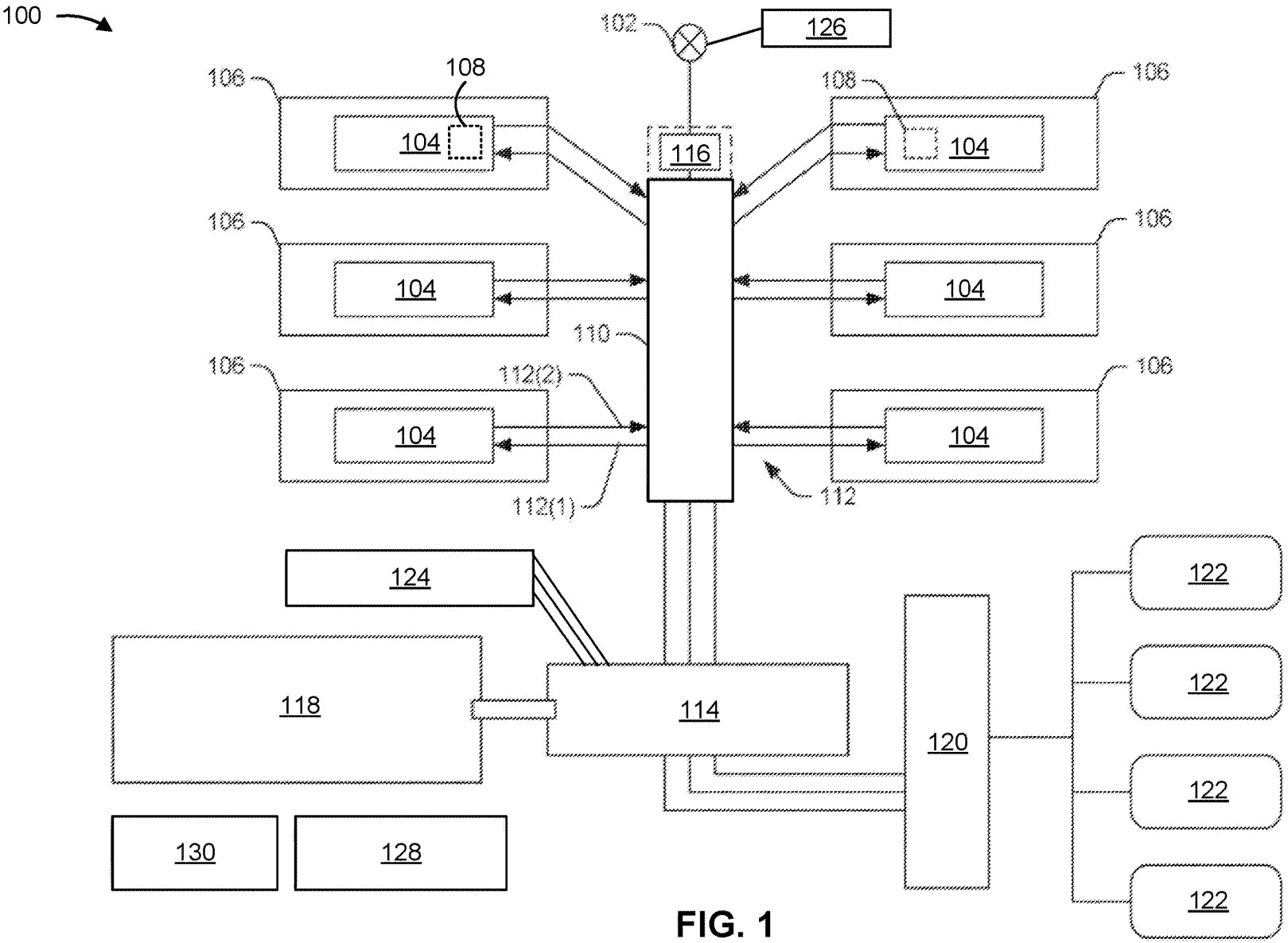
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. As described previously, hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells. The fluid pumps 108, the fluid conduits 112, the manifold 110, and/or the fracturing head 116 may define a fluid system of the hydraulic fracturing system 100. As described herein, a pressure test of the fluid system may be conducted to test an integrity of the fluid system.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other type of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 is in communication (e.g., by a wired connection or a wireless connection) with the pump systems 104 of the trailers 106. The controller 130 may also be in communication with other equipment and/or systems of the hydraulic fracturing system 100. The controller 130 may include one or more memories, one or more processors, and/or one or more communication components. The controller 130 (e.g., the one or more processors) may be configured to perform operations associated with controlling a discharge pressure from the fluid pumps 108, as described in connection with FIG. 2.

As indicated above, FIG. 1 is provided as an example. Other examples may differ from what is described with regard to FIG. 1.

Figure 2:
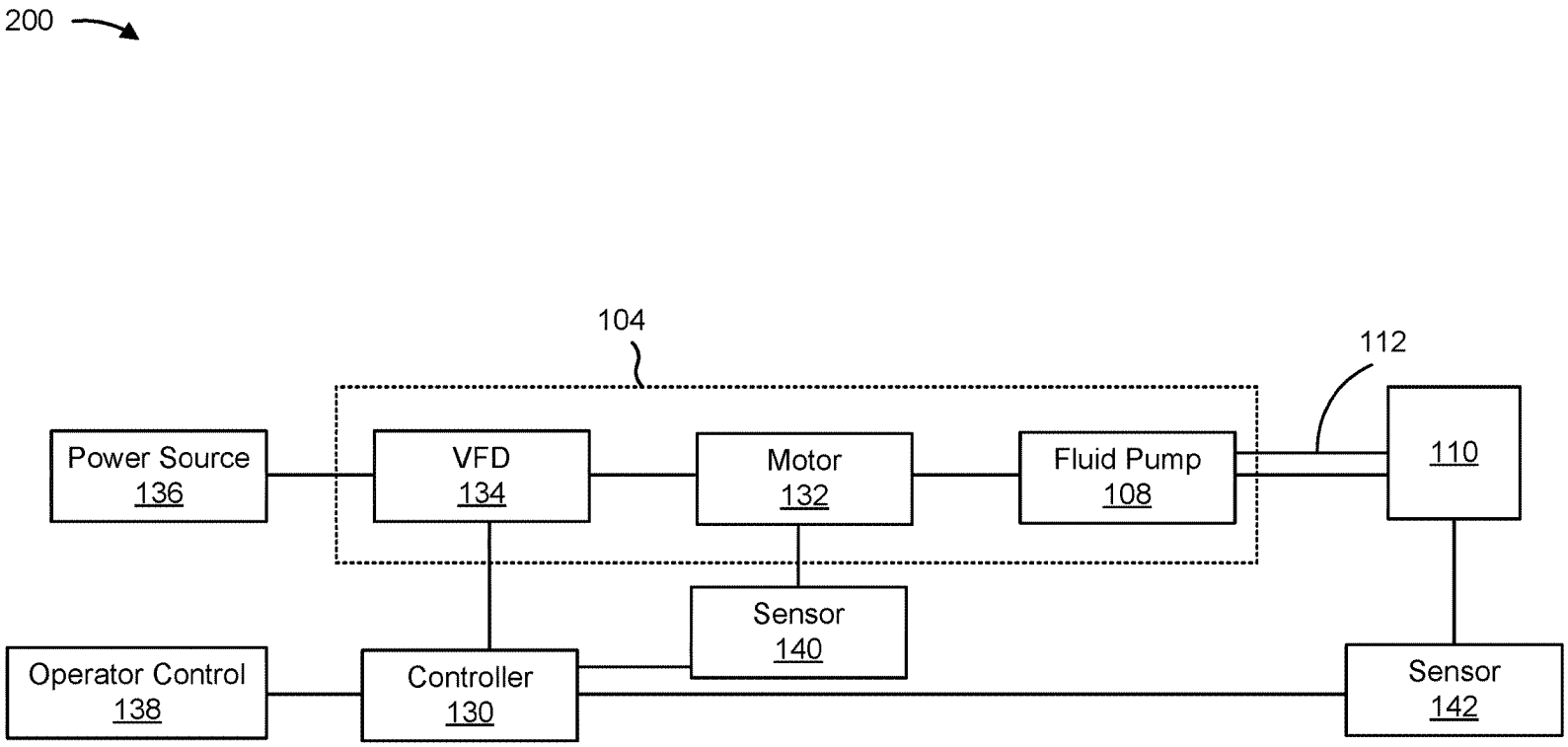
FIG. 2 is a diagram illustrating an example control system.

FIG. 2 is a diagram illustrating an example control system 200. The control system 200 may include one or more components of the hydraulic fracturing system 100, as described herein.

As shown in FIG. 2, the control system 200 includes a pump system 104, and the pump system 104 includes a fluid pump 108, as described herein. The pump system 104 also includes a motor 132 configured to drive (e.g., via a driveshaft) the fluid pump 108. The motor 132 may include an electric motor (e.g., an alternating current (AC) electric motor), such as an induction motor or a switched reluctance motor. In some examples, the fluid pump 108 and the motor 132 may share a housing. The pump system 104 also includes a variable frequency drive (VFD) 134 that controls the motor 132. For example, the VFD 134 includes an electro-mechanical drive system configured to control a speed and/or a torque of the motor 132 by varying an input frequency and/or input voltage to the motor 132. The pump system 104 may receive electrical power from a power source 136. For example, the power source 136 may be a generator, a generator set, a battery, one or more solar panels, an electrical utility grid, an electrical microgrid, or the like.

As shown in FIG. 2, the control system 200 includes at least one fluid conduit 112 and/or the manifold 110, as described herein. The fluid conduit(s) 112 may be in fluid communication with the fluid pump 108. For example, the fluid conduit(s) 112 may fluidly connect the fluid pump 108 and the manifold 110, the manifold 110 and the well 102 (e.g., via the fracturing head 116), or the like. In other words, the fluid conduit(s) 112 may fluidly connect components of the hydraulic fracturing system 100 that are downstream of the manifold 110 and/or the fluid pump 108.

The control system 200 may be configured to conduct a pressure test of a fluid system, such as the hydraulic fracturing system 100 or a sub-system thereof, the control system 200 or a sub-system thereof, or the like (e.g., the pressure test may be a site-wide pressure test in connection with multiple trailers 104 and associated flow iron). For example, the control system 200 may be configured to conduct a pressure test of components of the hydraulic fracturing system 100 involved in the pressurization and transport of hydraulic fracturing fluid from one or more fluid pumps 108 to the well 102 (e.g., from the one or more fluid pumps 108 to the fracturing heat 116 or to a point downstream of the fracturing head 116). In particular, the control system 200 may be configured to conduct a pressure test of one or more fluid pumps 108, the fluid conduit(s) 112, and/or the manifold 110. The pressure test may test an integrity of these components to identify leaks, areas of failure, or the like.

As shown in FIG. 2, the control system 200 includes the controller 130. The controller 130 may be configured to perform operations associated with the pressure test, as described herein. The controller 130 may be a component of the VFD 134, or the controller 130 may be a component separate from the VFD 134. For example, the controller 130 may be a pump-specific controller for the pump system 104, or the controller 130 may be a system-wide controller for the hydraulic fracturing system 100.

The controller 130 may obtain a setting for a target discharge pressure associated with the fluid pump 108. For example, the setting for the target discharge pressure may indicate a target discharge pressure for the fluid pump 108 or a target discharge pressure of a fluid system that includes the fluid pump 108 and at least one additional fluid pump (e.g., where fluid flows of the fluid pumps are combined at the manifold 110). The target discharge pressure may be for use in the pressure test. For example, the target discharge pressure may be a peak discharge pressure at which the pressure test is to be conducted. In some implementations, the controller 130 may obtain the setting for the target discharge pressure from a local or a remote memory or other storage, from another device, or the like. For example, the setting for the target discharge pressure may be configured for the controller 130. Additionally, or alternatively, to obtain the setting for the target discharge pressure, the controller 130 may receive an input (e.g., an operator input) that indicates the setting for the target discharge pressure. For example, the controller 130 may receive the input from an operator control 138 (e.g., a human-machine interface). The operator control 138 may be located at the data monitoring system 128, elsewhere at a hydraulic fracturing site, or remote from the hydraulic fracturing site.

The controller 130 may receive an indication to initiate the pressure test. For example, the controller 130 may receive the indication to initiate the pressure test from the operator control 138. The indication to initiate the pressure test may be reception of the setting for the target discharge pressure, or the indication to the initiate the pressure test may be a separate indication received by the controller 130 before or after reception of the setting for the target discharge pressure.

The controller 130 may determine a target torque for the motor 132 that achieves the target discharge pressure (e.g., achieves the target discharge pressure for the fluid pump 108 or for the fluid system that includes the fluid pump 108 and at least one additional fluid pump). The controller 130 may determine the target torque for the motor 132, that achieves the target discharge pressure, based on a configuration of the pump system 104 (or a configuration of the hydraulic fracturing system 100, the control system 200, or the like). The configuration of the pump system 104 may include a gear ratio of the fluid pump and/or the motor 132, a stroke length of the fluid pump 108, a bore diameter (e.g., a plunger diameter) of the fluid pump 108, and/or a parasitic loss associated with the fluid pump 108, among other examples. In some implementations, the controller 130 may determine the maximum torque for the motor 132, that achieves the maximum discharge pressure, using a look-up table, a torque curve, a physics-based estimation model, an artificial intelligence technique (e.g., a machine learning model), or the like (e.g., that is based on the configuration of the pump system 104, an age of the pump system 104, or the like).

In connection with conducting the pressure test (e.g., after the indication to initiate the pressure test is received), the controller 130 may cause closing of a valve (not shown) that controls fluid flow to the well 102 (e.g., the pressure test is performed against the closed valve). In some examples, the valve may be closed manually.

Moreover, in connection with the pressure test, the controller 130 may adjust, or cause adjustment to, a speed of the motor 132 to achieve the target torque for the motor 132. The controller 130 may cause adjustment of the speed of the motor 132 via the VFD 134 (e.g., by communicating with a motor control processing unit of the VFD 134). For example, the controller 130 may set a torque setting (e.g., a torque target setting or a torque limit setting), in a control mode (e.g., a torque control mode or a speed control mode) for the VFD 134, to the target torque. In accordance with the torque setting being set to the target torque, the VFD 134 may control the motor 132 by adjusting (e.g., increasing) the speed of the motor 132 to achieve the target torque. In other words, the controller 130 may cause adjustment of the speed of the motor 132 by causing the VFD 134 to vary an input frequency and/or an input voltage to the motor 132 to achieve the target torque. In this way, the controller 130, via the VFD 134, controls the speed of the motor to achieve the target torque, thereby achieving the target discharge pressure for the pressure test. Additionally, the controller 130 may maintain, using the VFD 134, a torque of the motor 132 at the target torque.

During the pressure test (e.g., to achieve the target torque or to maintain the target torque), the controller 130 may monitor a torque of the motor 132 to identify a deviation from the target torque. Thus, the controller 130 may adjust, or cause adjustment to, the speed of the motor 132 (e.g., including control of a rate of change of the speed of the motor 132 for improved stabilization), as described herein, based on the deviation. In this way, a stabilized discharge pressure may be achieved. To monitor the torque of the motor 132, the controller 130 may determine an estimated actual torque of the motor 132 and/or be configured to obtain a measurement of the actual torque of the motor 132. The controller 130 may determine the estimated torque of the motor 132 based on a magnetic flux of the motor 132 and/or a current of an armature of the motor 132. The controller 130 may obtain the measurement of the torque of the motor 132 from a sensor 140 (e.g., a torque transducer) configured to detect the torque of the motor 132. The sensor 140 may be located at an output shaft of the motor 132.

In some implementations, the controller 130 may obtain a measurement of the actual discharge pressure associated with the fluid pump 108, which the controller 130 may use (e.g., additionally, or alternatively, to the estimated torque and/or the measurement of the torque) for adjusting the speed of the motor 132 (e.g., the controller 130 may adjust the target torque to account for a deviation of the actual discharge pressure from the target discharge pressure). The controller 130 may obtain the measurement of the discharge pressure from a sensor 142 (e.g., a pressure sensor) configured to detect the discharge pressure. The sensor 142 may detect the discharge pressure at the manifold 110, as shown, or at a different component of the control system 200, such as the fluid pump 108 or the fluid conduit 112.

The controller 130 may determine whether the fluid system has passed or failed the pressure test. The controller 130 may determine that the fluid system has failed the pressure test if one or more measurements obtained by the controller 130 (e.g., during the pressure test, such as at one or more time points associated with ramp up to the target discharge pressure and/or at one or more time points associated with achievement of the target discharge pressure) are indicative of a leak, or another failure, in the fluid system. Otherwise, the controller 130 may determine that the fluid system has passed the pressure test. In one example, the controller 130 may obtain a measurement relating to a pressure in the fluid conduit(s) 112 and/or the manifold 110, and to determine whether the measurement is indicative of a leak in the fluid system (e.g., if the measurement satisfies a threshold value or is non-linearly increasing or decreasing). In another example, the controller 130 may determine whether fluctuations of the torque of the motor 132 (e.g., based on an estimated actual torque or a measured actual torque, as described herein) are indicative of a leak in the fluid system (e.g., if a degree of the fluctuations satisfies a threshold value).

The controller 130 may generate information indicating whether the fluid system has passed or failed the pressure test. For example, the information may include an indication of passing or failing the pressure test, data relating to the pressure test, or the like. The controller 130 may provide the information to the operator control 138 for display to an operator. The pressure test may be completed upon achievement of the target torque/target discharge pressure or maintenance of the target torque/target discharge pressure for a particular time period.

While the description herein is described in terms of controlling discharge pressure by adjusting the speed of a single motor 132, in some implementations, the controller 130 may cause adjustment of speeds for multiple motors 132 that drive respective fluid pumps 108 (e.g., of respective trailers 106).

As indicated above, FIG. 2 is provided as an example. Other examples may differ from what is described with regard to FIG. 2.

Figure 3:
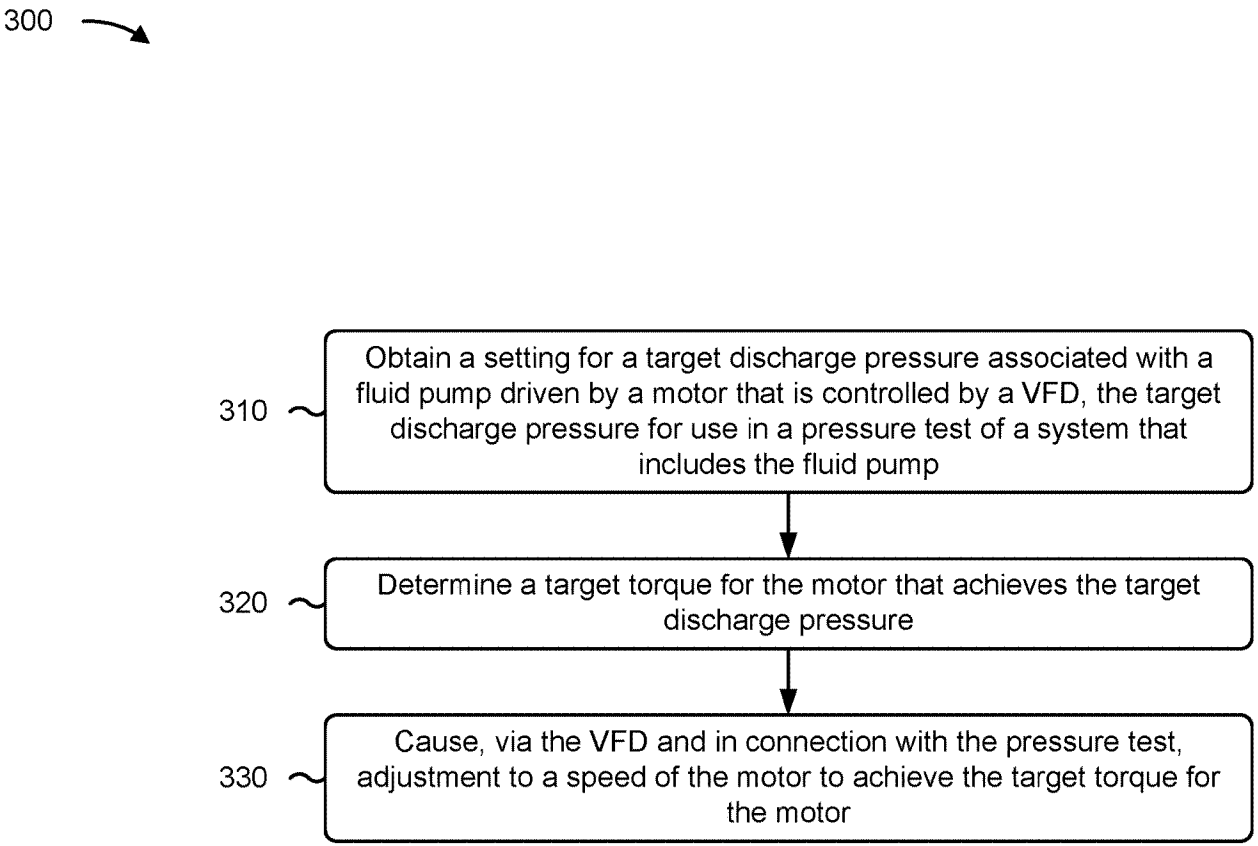
FIG. 3 is a flowchart of an example process relating to controlling a discharge pressure from a pump for pressure testing a fluid system.

FIG. 3 is a flowchart of an example process 300 associated with controlling a discharge pressure from a pump for pressure testing a fluid system. One or more process blocks of FIG. 3 may be performed by a controller (e.g., controller 130). Additionally, or alternatively, one or more process blocks of FIG. 3 may be performed by another device or a group of devices separate from or including the controller, such as another device or component that is internal or external to the hydraulic fracturing system 100. Additionally, or alternatively, one or more process blocks of FIG. 3 may be performed by one or more components of a device, such as a processor, a memory, an input component, an output component, and/or communication component.

As shown in FIG. 3, process 300 may include obtaining a setting for a target discharge pressure associated with a fluid pump driven by a motor that is controlled by a VFD, the target discharge pressure for use in a pressure test of a system that includes the fluid pump (block 310). For example, the controller (e.g., using a processor, a memory, a storage component, a communication component, or the like) may obtain a setting for a target discharge pressure associated with a fluid pump, as described above. Obtaining the setting for the target discharge pressure may include receiving an input that indicates the setting for the target discharge pressure.

As further shown in FIG. 3, process 300 may include determining a target torque for the motor that achieves the target discharge pressure (block 320). For example, the controller (e.g., using a processor, a memory, or the like) may determine a target torque for the motor that achieves the target discharge pressure, as described above. The target torque for the motor that achieves the target discharge pressure may be determined based on a configuration of the fluid pump that includes one or more of a gear ratio of the fluid pump and/or the motor, a stroke length of the fluid pump, or a bore diameter of the fluid pump.

As further shown in FIG. 3, process 300 may include causing, in connection with the pressure test, adjustment to a speed of the motor to achieve the target torque for the motor (block 330). For example, the controller (e.g., using a processor, a memory, a communication component, or the like) may cause, in connection with the pressure test, adjustment to a speed of the motor to achieve the target torque for the motor, as described above.

Causing adjustment to the speed of the motor may include setting a torque setting in a control mode for the VFD to the target torque and/or causing the VFD to vary at least one of an input frequency or an input voltage to the motor. Moreover, causing adjustment to the speed of the motor may include monitoring a torque of the motor to identify a deviation from the target torque for the motor, and causing adjustment to the speed of the motor based on the deviation. Monitoring the torque of the motor may include determining an estimated torque of the motor and/or obtaining a measurement of the torque of the motor. In some implementations, process 300 may include obtaining at least one of an estimated torque of the motor, a measurement of the torque of the motor, or a measurement of a discharge pressure associated with the fluid pump, and adjusting the speed of the motor to achieve the target torque for the motor based on the at least one of the estimated torque, the measurement of the torque, or the measurement of the discharge pressure.

Process 300 may further include determining whether the system has passed or failed the pressure test, and generating information indicating whether the system has passed or failed the pressure test. Determining whether the system has passed or failed the pressure test may include obtaining a measurement relating to a pressure in the at least one fluid conduit, and determining whether the measurement is indicative of a leak in the system. Additionally, or alternatively, determining whether the system has passed or failed the pressure test may include determining whether fluctuations of a torque of the motor are indicative of a leak in the system.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The control system described herein may be used with any hydraulic fracturing system that pressurizes hydraulic fracturing fluid using motor-driven pumps. For example, the control system may be used with a hydraulic fracturing system that pressurizes hydraulic fracturing fluid using a pump that is driven by a motor that is controlled by a VFD. The control system is useful for providing automatic control of a pressure test for the hydraulic fracturing system. In particular, the control system may automatically pressurize the hydraulic fracturing system to a target discharge pressure used for the pressure test, and the control system may maintain the hydraulic fracturing system at the target discharge pressure for a duration of the pressure test. The control system may achieve the target discharge pressure by translating the target discharge pressure to a target torque for the motor, and controlling a speed of the motor, via the VFD, to achieve the target torque.

Thus, relative to manually-controlled pressure testing, the control system provides improved control of a pressure test. For example, the control system is capable of accurately achieving a target discharge pressure used for a pressure test, thereby improving a success rate for pressure testing and reducing damage to the hydraulic fracturing system resulting from over pressurization. By improving the success rate, fewer repetitions of the pressure test are needed, thereby reducing wear to the hydraulic fracturing system. In addition, the control system is capable of maintaining the hydraulic fracturing system at the target discharge pressure for the duration of a pressure test, thereby improving an accuracy of the pressure test.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc., depending on the context.

What is claimed is:

1. A system for hydraulic fracturing, comprising:
at least one fluid conduit;
a fluid pump in fluid communication with the at least one fluid conduit;
a motor configured to drive the fluid pump;
a variable frequency drive (VFD) configured to control the motor; and
a controller configured to:
receive an indication to initiate a pressure test of the system,
wherein the indication to initiate the pressure test is or is separate from an input that indicates a setting for a target discharge pressure associated with the fluid pump that is to be used for the pressure test;
determine a target torque for the motor, that achieves the target discharge pressure, based on a configuration of the fluid pump;
monitor, during the pressure test, a torque of the motor to identify a deviation from the target torque for the motor; and
cause, via the VFD and in connection with the pressure test, adjustment to a speed of the motor to achieve the target torque for the motor and based on the deviation from the target torque for the motor.

2. The system of claim 1, wherein the controller, to cause adjustment to the speed of the motor, is configured to:
set a torque setting in a control mode for the VFD to the target torque.

3. The system of claim 1, wherein the controller, to monitor the torque of the motor, is configured to:
determine an estimated torque of the motor, or
obtain a measurement of the torque of the motor.

4. The system of claim 1, wherein the controller is further configured to:
determine whether the system has passed or failed the pressure test; and
generate information indicating whether the system has passed or failed the pressure test.

5. The system of claim 4, wherein the controller, to determine whether the system has passed or failed the pressure test, is configured to:
obtain a measurement relating to a pressure in the at least one fluid conduit; and
determine whether the measurement is indicative of a leak in the system.

6. The system of claim 1, wherein the configuration of the fluid pump includes one or more of:
a gear ratio of the fluid pump,
a stroke length of the fluid pump, or
a bore diameter of the fluid pump.

7. The system of claim 1, wherein at least the fluid pump and the motor are mounted on a hydraulic fracturing trailer.

8. A method, comprising:
identifying, by a controller, target discharge pressure, associated with a fluid pump driven by a motor that is controlled by a variable frequency drive (VFD), for use in a pressure test;
determining, by the controller, a target torque for the motor that achieves the target discharge pressure;
monitoring, during the pressure test, a torque of the motor to identify a deviation from the target torque for the motor; and
causing, by the controller via the VFD and in connection with the pressure test, adjustment to a speed of the motor based on the deviation from the target torque for the motor.

9. The method of claim 8, further comprising:
receiving an indication to initiate the pressure test; and
receiving an input that indicates a setting for the target discharge pressure,
wherein the indication to initiate the pressure test is separate from the input that indicates the setting for the target discharge pressure.

10. The method of claim 8, wherein causing adjustment to the speed of the motor comprises:
causing the VFD to vary at least one of an input frequency or an input voltage to the motor.

11. The method of claim 8, further comprising:
determining whether the system has passed or failed the pressure test; and generating information indicating whether the system has passed or failed the pressure test.

12. The method of claim 11, wherein determining whether the system has passed or failed the pressure test comprises:

determining whether fluctuations of a torque of the motor are indicative of a leak in the system.

13. The method of claim 8, wherein the fluid pump is a hydraulic fracturing pump.

14. A controller, comprising:

one or more memories; and one or more processors configured to:

identify a target discharge pressure for use in a pressure test of a system that includes a fluid pump driven by a motor that is controlled by a variable frequency drive (VFD);

determine a target torque, for the motor, that achieves the target discharge pressure;

monitor, during the pressure test, a torque of the motor to identify a deviation from the target torque for the motor; and maintain or achieve, using the VFD and during the pressure test, the target torque for the motor based on the deviation from the target torque for the motor.

15. The controller of claim 14, wherein the one or more processors, to determine the target torque for the motor, are configured to:

determine the target torque, for the motor, that achieves the target discharge pressure based on a configuration of the fluid pump that includes one or more of a gear ratio of the fluid pump, a stroke length of the fluid pump, or a bore diameter of the fluid pump.

16. The controller of claim 14, wherein the one or more processors, to maintain or achieve the target torque for the motor, are configured to:

adjust a speed of the motor based on the deviation from the target torque for the motor.

17. The controller of claim 14, wherein the one or more processors, to monitor the torque of the motor, are configured to:

obtain at least one of an estimated torque of the motor, a measurement of the torque of the motor, or a measurement of a discharge pressure associated with the fluid pump.

18. The controller of claim 14, wherein the one or more processors are further configured to:

determine whether the system has passed or failed the pressure test; and generate information indicating whether the system has passed or failed the pressure test.

19. The controller of claim 14, wherein the one or more processors, to maintain or achieve the target torque for the motor, are configured to:

control, based on the deviation from the target torque for the motor, a rate of change of a speed of the motor.

20. The controller of claim 14, wherein the one or more processors, to monitor the torque of the motor, are configured to:

determine an estimated torque of the motor based on one or more of a magnetic flux of the motor or a current of an armature of the motor, or obtain, from a sensor of the motor, a measurement of the torque of the motor.

* * * * *